US005937616A

United States Patent [19]

Ray

[11] Patent Number: 5,937,616

[45] Date of Patent: Aug. 17, 1999

[54] VIAL CAPPING MACHINE

[76] Inventor: John D. Ray, 9035 Old Terry Ford Rd., Gainesville, Ga. 30506

[21] Appl. No.: 09/064,456

[22] Filed: Apr. 22, 1998

[51] Int. Cl.[6] ..... B65B 7/28

[52] U.S. Cl. ..... 53/201; 53/316; 29/401.1; 29/426.1

[58] Field of Search ..... 53/313, 314, 315, 53/316, 201; 29/401.1, 426.1

[56] References Cited

U.S. PATENT DOCUMENTS 3,191,359 6/1965 Stark ..... 53/282
4,095,390 6/1978 Knudsen ..... 53/39
4,122,649 10/1978 Sawvel ..... 53/306
4,835,943 6/1989 Mueller ..... 53/485

*Primary Examiner*—John Sipos
*Attorney, Agent, or Firm*—Kenneth S. Watkins, Jr.

[57] ABSTRACT

A machine for capping a tray of specimen vials comprises two driven rollers, a table, and a frame. The tray of vials having caps set in the vials but not fully inserted in fed into the entrance end of the machine. A first driven roller engages the caps, inserting the caps to a first inserted position and driving the tray to the second driven roller. The second driven roller engages the caps in the first inserted position, inserting the caps to a fully inserted position and driving the tray to the exit end of the machine. The machine may be made from a wood planer by disabling the rotating blade.

5 Claims, 6 Drawing Sheets

VIAL CAPPING MACHINE

BACKGROUND OF THE INVENTION

The present invention relates to inserting caps in vials used for medical test samples and, more particularly, to machines that cap a plurality of vials.

Capped vials are often used in the medical applications for mixing, storing, and sampling cultures, drugs and other various test samples. Often, many samples must be tested, requiring filling, capping and other handling operations of a large number of sample vials or containers. Capped vials are also used for storing small parts such as electronic components and chips which require protection from dust and other contamination.

Sample trays are used for storage, handling and use of large numbers of vials. Two axis positioners are available to fill or sample individual vials in the tray. However, capping of the vials once these operations are completed is still often done manually. Manual capping is manual labor intensive, slow, and may result in spillage or contamination of the samples. Full insertion of caps is repetitive, tedious and requires substantial insertion force. Long term repetition of such a task may result in adverse medical conditions.

U.S. Pat. No. 4,095,390 discloses a machine and process for capping and sealing containers. The machine caps containers are they are fed on a conveyor. The machine is large and complicated, and is not cable of capping a tray of vials.

OBJECTS AND SUMMARY OF THE INVENTION

Therefore and object of the present invention is to provide a machine that fully inserts caps in a plurality of vials.

A further object of the present invention is to provide a machine that fully inserts caps in vials arranged in a tray.

A further object of the present invention is to provide a machine that fully inserts vial caps quickly with little labor required, thereby reducing fatigue and stress to the user.

A further object of the present invention is to provide a machine that caps vials without spillage or contamination.

A further object of the present invention is to provide a machine which caps vials that is simple and low in cost.

The vial capping machine comprises two rollers and a table supported by a frame. The rollers are rotateably driven by a motor. The table supports a tray of vials in which caps have been set into their openings but not fully inserted. As the tray is inserted into the entrance end of the machine, the first driven roller engages the caps of the vials, partially inserting the caps and driving the tray towards the second roller. The second roller engages the caps of the vials, and fully inserts the caps into the vials, and drives the tray to the exit end of the machine.

In the preferred embodiment, the bottom surface of the second roller is closer to the table top surface than the bottom surface of the first roller. This sequentially decreasing distance from the roller bottom surfaces to the table results in a "stepped" insertion of the caps. By inserting the caps in several small steps instead of one large one, insertion is more reliable, and reduces breakage and spillage of vial contents. Small insertion steps also improves the ability of the rollers to drive wide trays containing more vials. In other embodiments, additional rollers may be mounted between the first and second rollers. The additional rollers would be mounted so that the distance from the table top surface to the roller bottom surface is less than the preceding roller and greater than the following roller. The additional rollers may be driven or not driven.

In order to provide for different vials and cap configurations, or different tray designs, the distance between the rollers and the table surface may be adjusted by adjusting the table height. In other embodiments, the distance between the rollers and the table surface may be adjusted by adjusting the height of a sub-frame supporting the first and second rollers. In still other embodiments, the distance between the rollers and the table surface may be adjusted by providing shim plates between the table top surface and the vial tray. Transverse guides on the frame prevent transverse movement of the tray as it is driven from the entrance end to the exit end of the machine.

One embodiment of the invention is made from a conventional wood planer. The planer comprises two driven rollers, normally used to engage and drive a workpiece from the entrance end of the planer to the exit end of the planer. A rotary blade planes the surface of the workpiece as it is driven from the entrance end to the exit end. In this embodiment, the rotary blade is removed or otherwise disabled and the driven rollers engage the caps of the vials of a tray of vials fed into the entrance end. The caps are inserted into the vials in steps by the driven rollers. A transverse guide on each side of the table prevents transverse movement of the tray as it is driven through the machine. Table extensions may be added to the table at the entrance end and the exit end to support long trays. The planer thickness adjustment is used to adjust the distance between the roller bottom surfaces and the table top surface to account for different vials, caps, cap insertion, trays, and to set the initial insertion step.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a machine for capping a tray of vials that provides high productivity and is low in cost.

Figure 1:
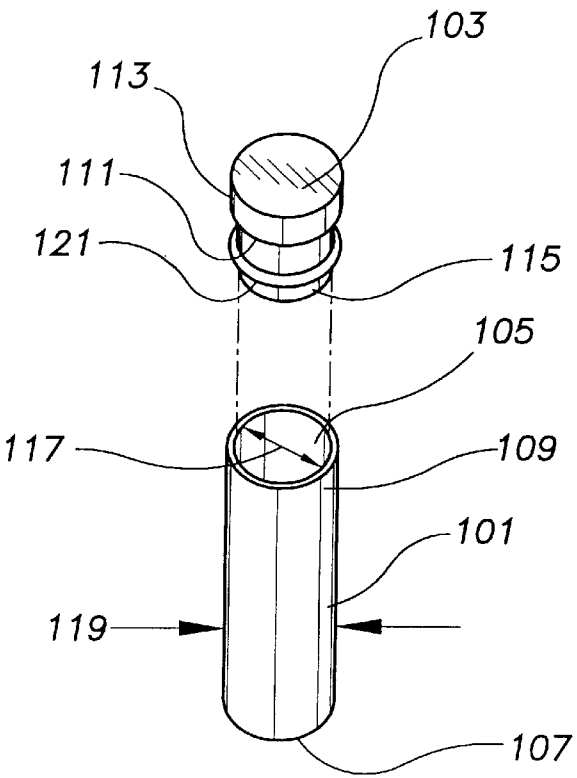
FIG. 1 is a perspective drawing of a vial and cap typical of those used for test samples.

FIG. 1 is a perspective drawing of a typical vial 101 and cap 103 used in drug and pharmaceutical, chemical, biochemical, and small parts storage applications. Vial 101 is made of glass, metal, ceramic, or plastic materials and comprises an opening 105 for inserting or removing contents from the vial. Vial 101 may be cylindrical in shape, as shown, or vial 101 may comprise a tapered or spherical shaped body. The lower portion may comprise a flat bottom 107, or the bottom may be tapered or hemispherical. The top portion 109 may be plain, as shown, or it may comprise a flange (not shown).

Cap 103 is made of plastic, rubber, glass, ceramic or metal. Cap 103 may comprise a shoulder 111 defining a top portion 113 and a lower portion 115. In other embodiments, cap 103 may be a stopper with tapered or cylindrical body (not shown). An interference fit between lower portion 115 of cap 103 and inside diameter 117 of vial 101 retains cap 103 in vial l and provides a seal for contents (not shown) of vial 101. Other retaining methods include cap flange 121 engaging the inner diameter of the vial. In still other embodiments, flange 121 engages a groove in the inner diameter of vial 101 (not shown).

Figure 2:
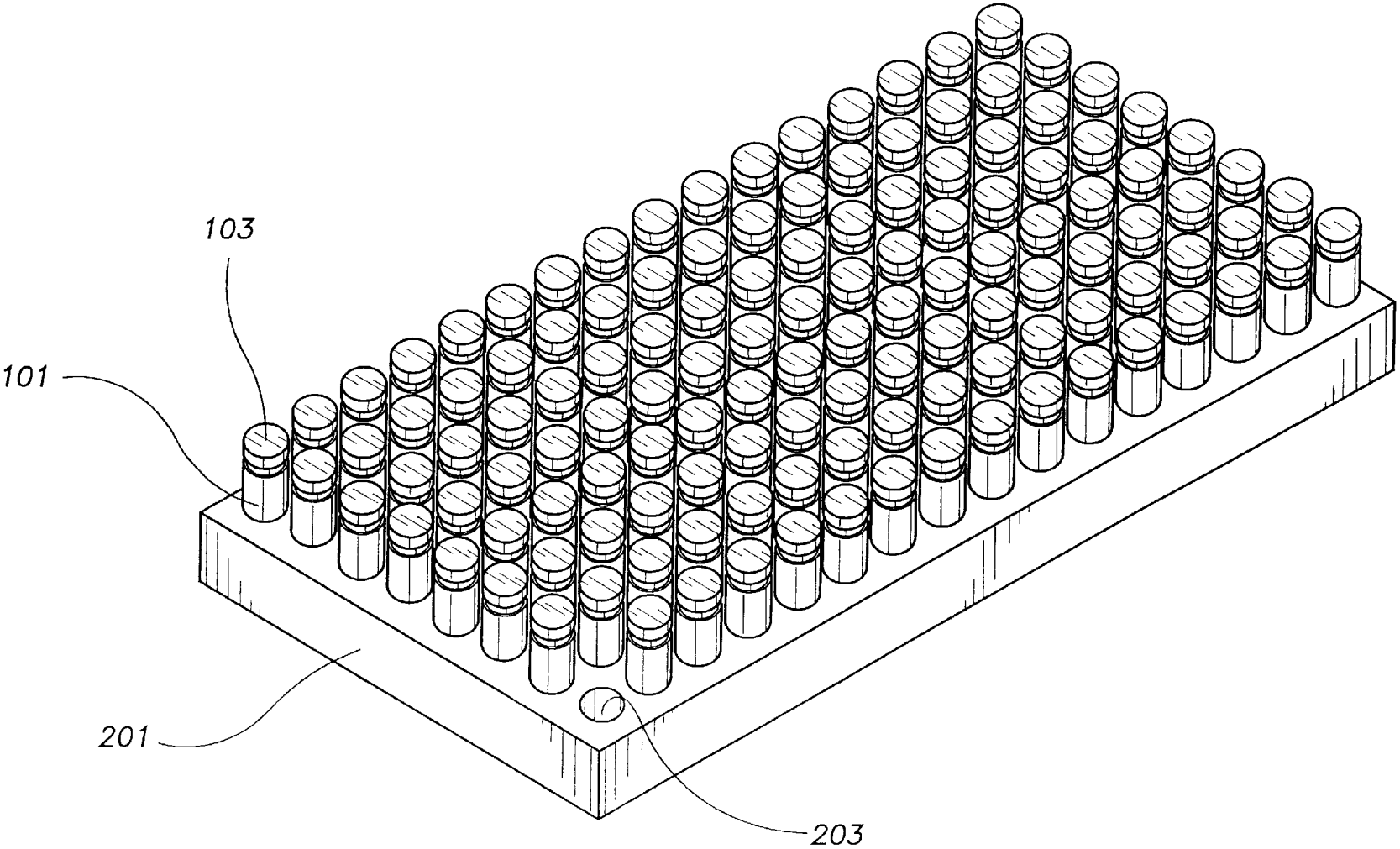
FIG. 2 is a perspective drawing of a tray of the vials of FIG. 1 with the caps set in the vials but not fully inserted.

FIG. 2 is a perspective drawing of a tray 201 comprising a plurality of wells 203. Wells 203 retain vials 101 inserted into the wells. The outside diameter (119 of FIG. 1) of vials 101 normally form a clearance fit with the inner diameter of wells 203. In other embodiments, the outer diameter 119 of vials 101 form a snug or interference fit in wells 203. Caps 103 are shown placed or set, but not fully inserted in vials 101. In the preferred embodiment, wells 203 comprise a bottom (302 of FIG. 3) which supports vial bottom 107. Tray 201 may be made of plastic, metal or composite materials. In the preferred embodiment, tray 201 is made of machined, die cast or injection molded plastic such as polyethylene.

Figure 3:
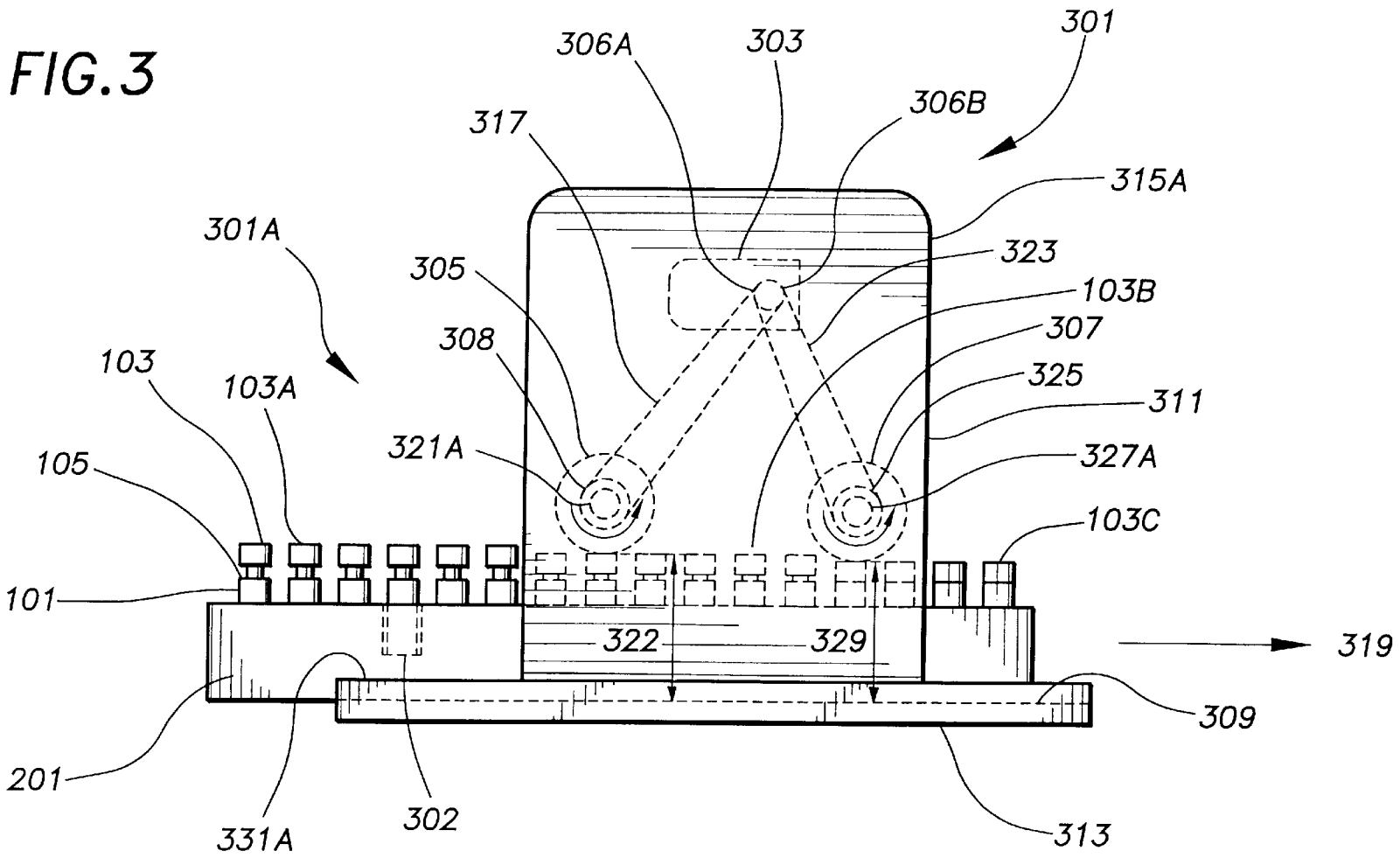
FIG. 3 is a side elevation drawing of a vial capping machine comprising two rollers which sequentially insert caps of vials in a tray from a set position to a fully inserted position.

FIG. 3 is a side elevation schematic drawing of embodiment 301 of a vial capping machine for fully inserting caps 103 in a tray 201 of vials 101 Caps 103 are shown set in the openings 105 of vials 101, but not inserted into the fully inserted position as shown in vial cap 103C. A drive motor such as gear motor 303, first roller 305, second roller 307, and table 309 are mounted on frame 311. Frame 311 comprises base 313 and columns 315A and 315B (shown in FIG. 4). Tray 201 is shown supported on table 309. First roller 305, driven by gear motor 303 through drive pulley 306A, drive belt 317, and roller pulley 308 engages caps 103 and drives tray 201 along table 309 and through machine 301 in the direction of arrow 319.

In the preferred embodiment, table 309 surface is smooth to allow tray 201 to slide easily on table 309. In other embodiments, table 309 may comprise a plurality of low friction elements such as rollers or one or more belts (not shown).

Bearings 321A and 321B (shown in FIG. 4) support first roller 305 rotateably at first distance 322 from table 309. First distance 322 is the distance from the bottom of roller 305 to table 309 top surface. First distance 322, being less than the distance from the top of caps 103 at entrance end 301A of machine 301, results in an insertion pressing force on caps 103, inserting them into vials 101 from the set-in position shown in 103A to the first insertion position shown in 103B.

Second roller 307, driven by gear motor 303 through drive pulley 306B, drive belt 323, and roller pulley 325 engages caps 103 and drives tray 201 along table 309 and through machine 301 in the direction of arrow 319. Bearings 327A and 327B (not shown) support second roller 307 rotateably at second distance 329 from table 309. Second distance 329, being less than the distance from the top of caps at position 103B to table 309 results in an insertion pressing force on caps 103, inserting them to vials 101 to the second or fully inserted position as shown in 103C. Guides 331A and 331B (FIG. 4) provide transverse support for tray 201.

Figure 4:
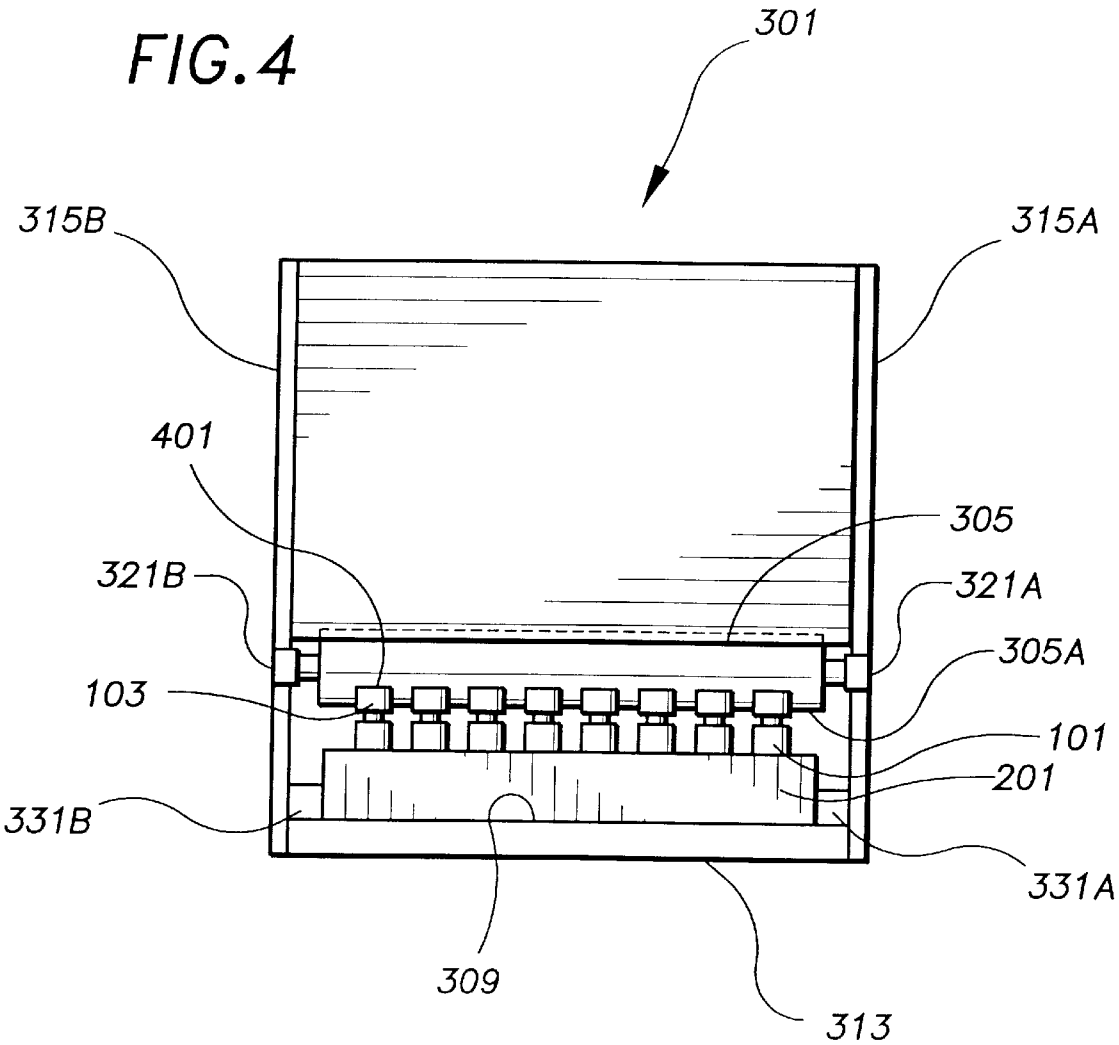
FIG. 4 is an end view of the machine of FIG. 3 showing a tray of vials with set caps entering the inlet end of the machine.

FIG. 4 is an end view of the vial capping machine of FIG. 3 looking at end 301A. Bearings 321A and 321B support first roller 305 from columns 315A and 315B so that the bottom surface 305A is lower than the tops 401 of vial caps 103. Bottom surface 305A of roller 305 forms a pressing surface for cap top surfaces 401. Table 309 of base 313 supports tray 201 containing vials 101. Guides 331A and 331B provide transverse support for tray 201, preventing lateral movement of tray 201 as it is driven through capping machine 301. Drive components are omitted to improve clarity.

In the preferred embodiment, first roller 305 is adjustable vertically in order to adjust for different vials, caps, and insertion depth. Bearings 321A and 321B may be positioned vertically by an adjusting mechanism such as lead screws or hydraulic cylinders (not shown) to position first roller 305 to the desired height above table 309. Similarly, an adjusting mechanism (not shown) may be used to adjust the height of second roller 307. In an alternative embodiment, roller bearings may be fixed as shown in FIG. 4 and table height 309 made adjustable by a table height adjustment mechanism (not shown). The relative distance from the bottom of the second roller to the top of the table surface 309 as compared to the first roller may be set by shimming the bearing housings, or utilizing a larger diameter second roller as compared to the first roller. A variety of mechanisms known in the machine tool art may be used as the adjustment mechanisms for adjusting the height of the rollers relative to the frame and the height of the table relative to the frame.

Figure 5:
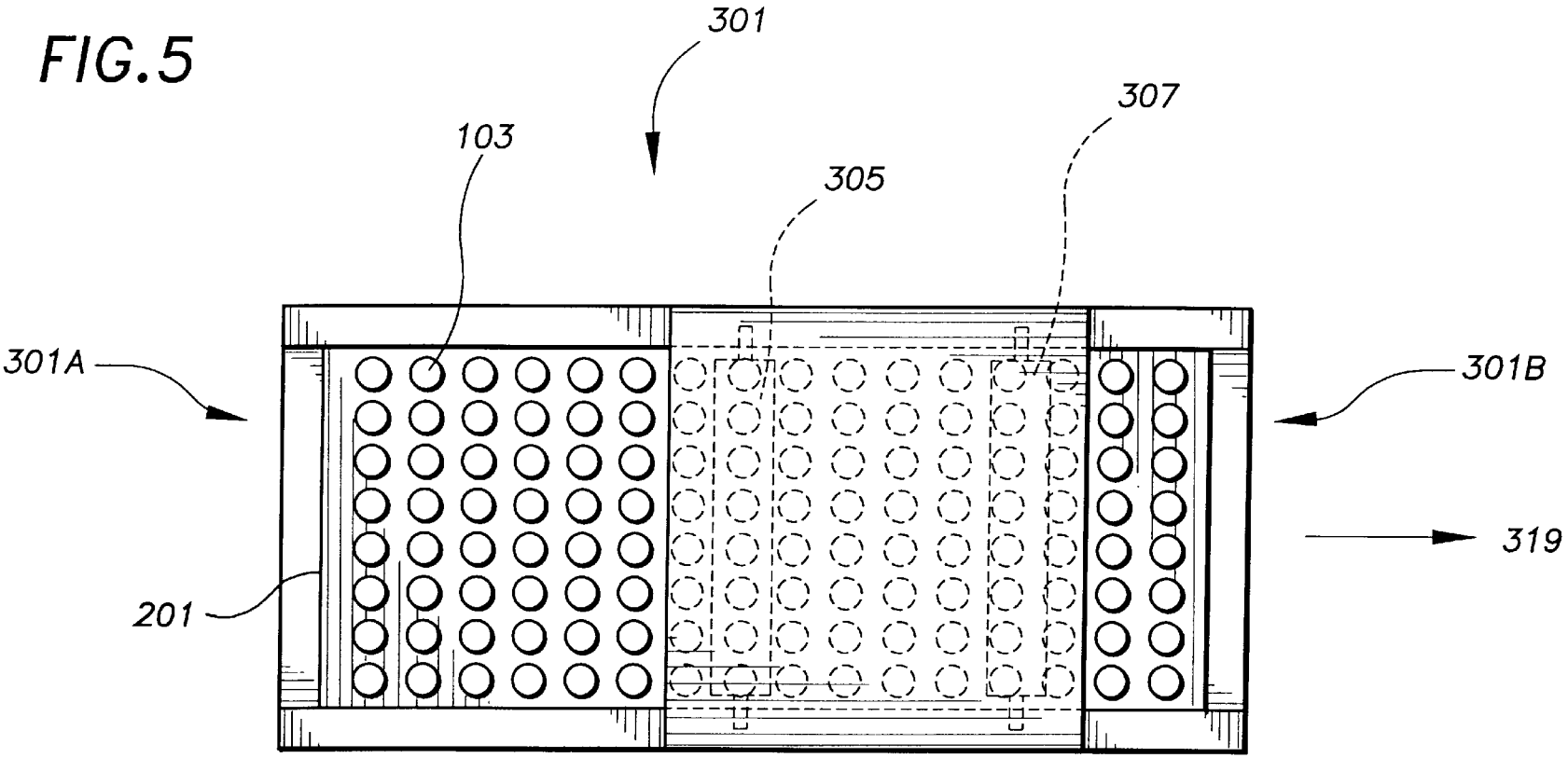
FIG. 5 is a top view of the machine of FIG. 3 showing a tray of vials being fed through the machine.

FIG. 5 is a plan view of vial capping machine 301. First roller 305 inserts caps 103 to a first inserted position as roller 305 drives tray 201 from entrance end 301A in direction 319. Second roller 307 inserts caps 103 to a second inserted position as roller 307 drives tray 201 in direction 319 and to the exit end 301B of the machine.

Figure 6:
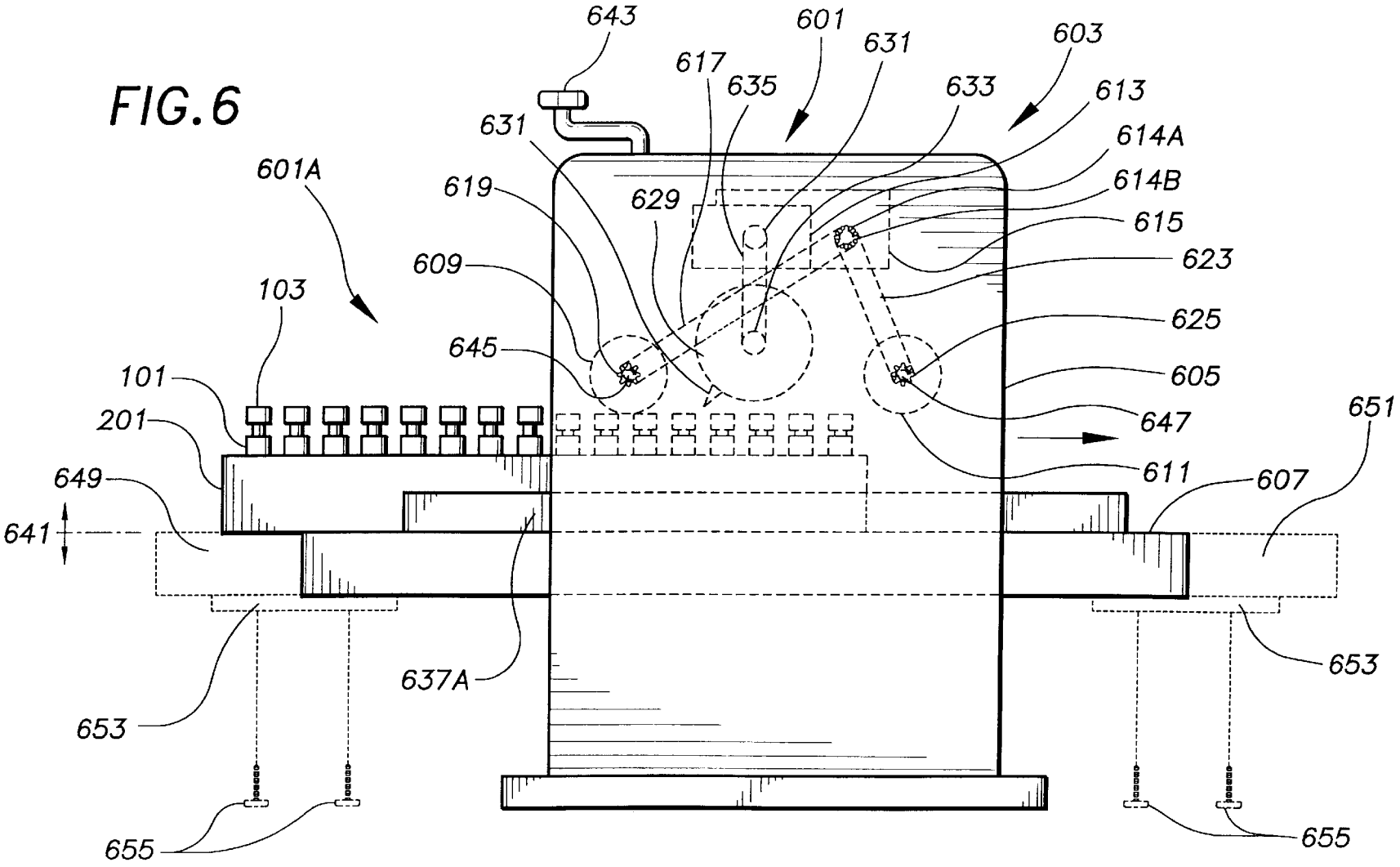
FIG. 6 is a side elevation view of a vial capping machine made by modifying a wood planing machine.

FIG. 6 is an elevation view of embodiment 601 of a vial capping machine utilizing a commercial or consumer wood planer 603 as the primary mechanism. Planer 603 is normally used to plane a surface of a wood workpiece fed into end 601 A. Planer 603 comprises a frame 605, table 607, first drive roller 609 and second drive roller 611. Drive motor 613 rotates first roller 609 through sprocket 614A of reducer 615, chain 617 and first roller sprocket 619. Drive motor 613 rotates second roller 611 through sprocket 614B of reducer 615, chain 623 and second roller sprocket 625. In wood planer 603, drive motor 613 rotates blade holder 629 through pulleys 631 and 633 and belt 635. Bearings of blade holder 629 are omitted for clarity.

Use of planer 603 as a capping machine requires disabling of blade 631 of wood planer 603. Cutting blade 631 of wood planer 603 is disabled by removal from blade holder 629. Other disabling means includes removal of blade holder 629, or removal of blade holder drive components including drive pulley 631, blade holder pulley 633, or belt 635. Other modifications to wood planer 603 to improve operation as a capping machine include installation of transverse guides 637A and 637B (opposite side, not shown), similar to guides 331A and 331B of FIG. 4. Guides 331A and 331B may be bonded to table 607 or attached by fasteners (not shown).

In the embodiment of planer 603 shown, the distance between table 607 and rollers 609 and 611 is adjusted by adjusting table 607 height in the direction shown by arrows 641. Table 607 height is adjusted by height adjuster 643. In other embodiments, the distance between table 607 and rollers 609 and 611 is adjusted by adjusting the height of a frame (not shown) supporting roller 609 bearing 645 and roller 611 bearing 647 and their respective back bearings. Other height adjustment methods include shimming the vertical position of roller bearings 645 and 647, placement of shims (not shown) between tray 201 and table 607, and varying the depth of well bottoms 302 of FIG. 3.

Planer 603 may be further modified by addition of table inlet extension 649 and table exit extension 651. Extensions 649 and 651 are attached to table 607 bottom by support plates 653 and fasteners 655.

Figure 7:
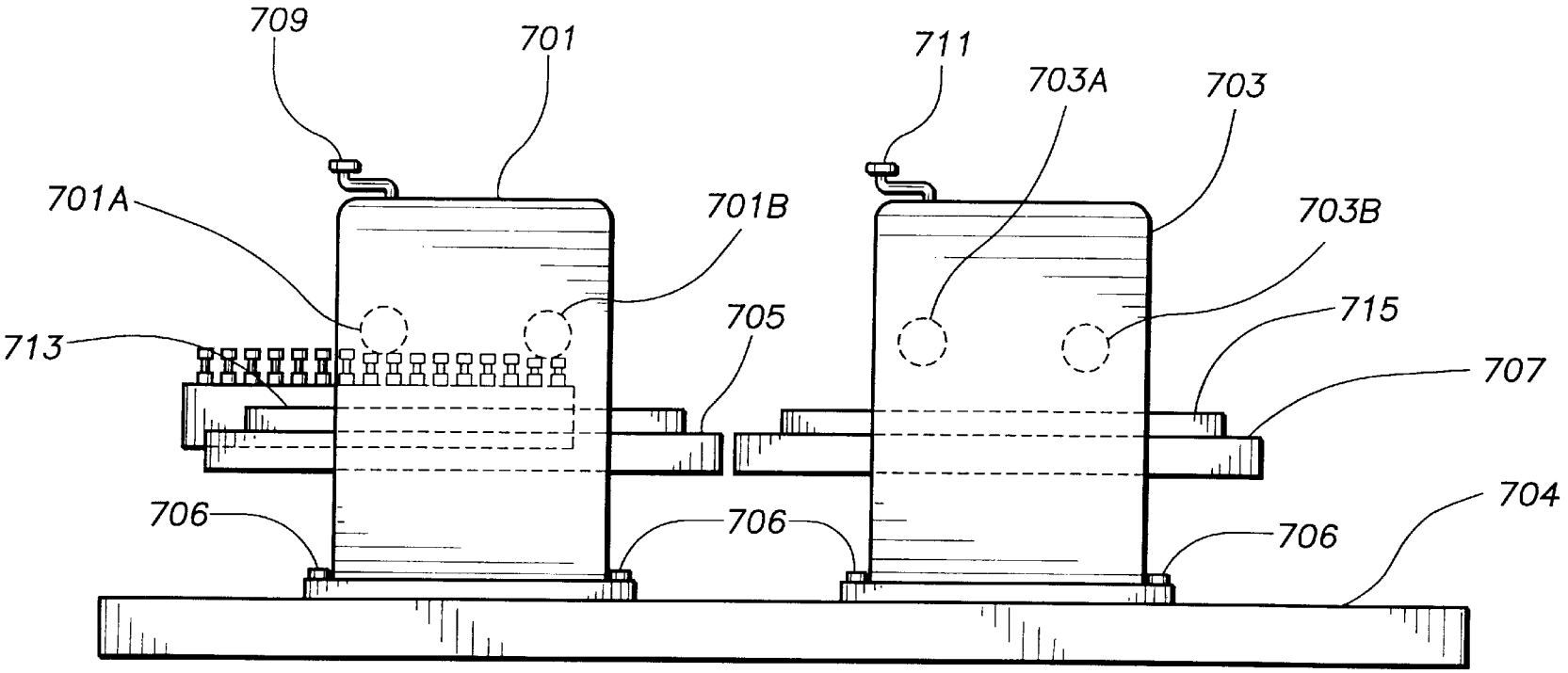
FIG. 7 is a side elevation drawing of a vial capping machine made from two modified wood planers, each wood planer comprising two rollers.

FIG. 7 is an elevation schematic drawing showing a vial capping apparatus using a first modified wood planer 701 and a second modified wood planer 703. In the preferred embodiment, planers 701 and 703 are fixed to a support member 704 by fasteners 706. In the preferred embodiment, table 705 of wood planer 701 and table 707 of wood planer 703 are fixed in height. The height of drive rollers 701A and 701B of planer 701 are adjusted by adjuster 709 and the height of drive rollers 703A and 703B of planer 703 are adjusted by adjuster 711.

Planers 701 and 703 are modified by disabling the rotating blades (not shown) and adding transverse guides 713 and 715 as described earlier. The use of two planers each comprising two drive rollers allows fine control of the cap insertion over four steps. The heights of the rollers are adjusted by the respective height adjusters 709 and 711. The height of each successive roller is adjusted by height adjusters 709, 711, and shims in the bearing housings to sequentially reduce the height between each roller and the table top surface from inlet of planer 701 to the outlet of planer 703. In other embodiments, roller heights are adjusted individually by shims (not shown). In still other embodiments, one or more drive rollers are removed or otherwise disabled.

Accordingly the reader will see that the VIAL CAPPING MACHINE provides a simple device for capping a plurality of vials in a tray. The machine provides the following additional features:

The machine caps a large number of vials quickly with little repetitive labor required;

Spillage of contents, breakage and contamination is reduced; and

The device may be made from a low cost, easily obtainable planer;

Although the description above contains many specifications, these should not be construed as limiting the scope of the invention but as merely providing illustrations of some of the presently preferred embodiments of this invention. For example, the drive rollers may be rotated by a hand crank instead of a motor. Thus the scope of the invention should be determined by the appended claims and their legal equivalents, rather than by the examples given.

I claim:

1. The method of using a wood planing tool as a machine for capping a plurality of vials in a tray comprising providing a wood planing tool comprising a table, at least one drive roller above the table and a rotating blade, disabling or removing the rotating blade to prevent the blade from contacting caps in the tray of vials and driving a tray of vials through said wood planning tool on said table to press the caps onto the vials by said drive roller.

2. The method of claim 1 wherein the modification of disabling the rotating blade comprises removing the rotating blade from the wood planing tool.

3. The method of claim 1 wherein the modification of disabling the rotating blade comprises relocating the rotating blade relative to said at least one drive roller.

4. The method of claim 1 wherein the wood planing tool is a first wood planing tool and the machine comprises a second wood planing tool, the second planing tool modified by disabling a rotating blade, the second wood planing tool disposed in a machine direction relative to the first wood planing tool so that the caps of the tray of vials are engaged by a drive roller of the second wood planing tool.

5. The method of converting a wood planing tool into a machine for capping a plurality of vials in a tray comprising providing a wood planing tool comprising a table, at least one drive roller above the table, a blade holder and a rotating blade, disabling or removing the rotating blade to prevent the blade from contacting caps in the tray of vials when the tray of vials are driven through said wood planning tool on said table to press the caps onto the vials by said drive roller.

* * * * *